US009404697B2

(12) United States Patent
Cobb

(10) Patent No.: US 9,404,697 B2
(45) Date of Patent: Aug. 2, 2016

(54) BULLET LOADER AND METHOD OF USE

(71) Applicant: Michael A. Cobb, Pinckney, MI (US)

(72) Inventor: Michael A. Cobb, Pinckney, MI (US)

( * ) Notice: Subject to any disclaimer, the term of this patent is extended or adjusted under 35 U.S.C. 154(b) by 0 days.

(21) Appl. No.: 14/879,047

(22) Filed: Oct. 8, 2015

(65) Prior Publication Data

US 2016/0102932 A1 Apr. 14, 2016

Related U.S. Application Data

(60) Provisional application No. 62/062,793, filed on Oct. 10, 2014.

(51) Int. Cl.
*F41A 9/83* (2006.01)

(52) U.S. Cl.
CPC ..... *F41A 9/83* (2013.01)

(58) Field of Classification Search
CPC ..... F41A 9/00; F41A 9/01; F41A 9/06; F41A 9/82; F41A 9/83
USPC ..... 42/87, 88; 89/45
See application file for complete search history.

(56) References Cited

U.S. PATENT DOCUMENTS

| | | | | | |
|---|---|---|---|---|---|
| 341,371 | A * | 5/1886 | Bruce | F41A 9/02 | 42/87 |
| 2,451,521 | A * | 10/1948 | Ugluml | F41A 9/83 | 244/155 A |
| 3,529,509 | A * | 9/1970 | Vuceta | F41A 9/01 | 89/33.03 |
| 4,173,211 | A * | 11/1979 | Crawford, Jr. | F41B 11/55 | 124/41.1 |
| 4,879,829 | A * | 11/1989 | Miller | F41A 9/83 | 42/87 |
| 4,970,820 | A * | 11/1990 | Miller | F41A 9/83 | 42/87 |
| 5,377,436 | A * | 1/1995 | Switzer | F41A 9/83 | 42/87 |
| 8,397,622 | B2 * | 3/2013 | Fowler, IV | F41A 9/30 | 89/45 |
| 2004/0020096 | A1 * | 2/2004 | Tal | F41A 9/83 | 42/87 |
| 2013/0067788 | A1 * | 3/2013 | Gray | F41A 9/84 | 42/88 |

* cited by examiner

*Primary Examiner* — Bret Hayes
(74) *Attorney, Agent, or Firm* — Jelic Patent Services, LLC; Stanley E. Jelic

(57) ABSTRACT

A bullet loader method and apparatus that enables a user to easily load bullets into a gun magazine. The gun magazine is inserted into the apparatus magazine opening. Bullets are individually loaded into the bullet loader with a grooved cam, so that the individual bullets rest in the groove. The cam is rotated so that the bullet travels within the groove(s) of the cam and pushed with a cog attached to the end of the groove into the magazine. The bullet is pushed into the magazine with both a downward and inward force to overcome the spring resistance of the magazine.

14 Claims, 12 Drawing Sheets

BULLET LOADER AND METHOD OF USE

CROSS-REFERENCE TO RELATED APPLICATIONS

This application claims the priority benefit of U.S. Provisional Application 62/062793 filed Oct. 10, 2014, which is herein incorporated by reference in its entirety.

TECHNICAL FIELD

The present disclosure relates to loading gun magazines with bullets. More particularly, the disclosure discusses a mechanical and automated method and system for efficiently inserting bullets into the magazines.

BACKGROUND

The statements in this section merely provide background information related to the present disclosure. Accordingly, such statements are not intended to constitute an admission of prior art.

Loading bullets in gun magazines can be time consuming and difficult. Bullets need to be manually inserted one-by-one in a magazine with both a downward and an inward force. The forces needed to insert the last few bullets can be excessive, since magazines have internal springs that become fully compressed with the last few bullets. Loading a full magazine is difficult for anyone and impossible for some people.

BRIEF SUMMARY OF THE INVENTION

In one embodiment, a bullet loader comprises a housing with an internal cam, wherein the cam has a first indentation configured to loosely hold a bullet, a second indentation which forms a half-cylinder shape, a third indentation configured to loosely hold the bullet, and a fourth indentation with a cog at an end.

In a separate embodiment, the bullet loader further comprises a handle attached to the internal cam that enables a user to rotate the cam.

In one embodiment, the handle and cam rotate 180 degrees from the start of bullet loading to the insertion of the bullet into the magazine. In separate embodiment, the rotation is 360 degrees. Total rotation of the cam and handle from the start of bullet loading to the insertion of the bullet into the magazine can vary from 90 to 360 degrees, depending upon the embodiment used.

In a separate embodiment, the cam further comprises a notch configured to enable the cam to be seated within the housing.

The housing can comprise two mirrored sections for easy assembly of the bullet loader. The housing has a magazine opening to insert a magazine and a feed opening to insert a bullet. In a separate embodiment, the housing has a rocker switch to lock a magazine into place.

The first indentation can have a depth from 5% to 50% of a bullet's diameter.

The second indentation can have a depth from 50% to 150% of a bullet's diameter.

The third indentation can have a depth equal to 5% to 75% of a bullet's diameter.

The fourth indentation can have a depth equal to 5% to 75% of a bullet's diameter.

In a separate embodiment, the indentations can be merged into one continuous indentation with regions that have greater depth and regions that have lesser depth.

In a separate embodiment, the bullet loader further comprises a hopper attached to the feed opening that is configured to automatically feed bullets into the feed opening in the proper orientation (bullet tip facing away from the magazine).

A method embodiment of using the bullet loader described above comprises: inserting a magazine into the magazine opening of the housing; locking the magazine into place with the rocker switch; aligning the cam so that the first indentation is aligned with the feed opening; inserting a bullet; rotating the cam to the second, third, and fourth cam positions consecutively so that the bullet is inserted into the magazine with both a downward and inward force; and iteratively repeating aligning, inserting, and rotating steps until the magazine is filled; unlocking the magazine with the rocker switch; and pulling the magazine out of the bullet loader.

The scope of the invention is defined by the claims, which are incorporated into this section by reference. A more complete understanding of embodiments on the present disclosure will be afforded to those skilled in the art, as well as the realization of additional advantages thereof, by consideration of the following detailed description of one or more embodiments. Reference will be made to the appended sheets of drawings that will first be described briefly.

BRIEF DESCRIPTION OF THE DRAWINGS

A clear understanding of the key features of the invention summarized above may be had by reference to the appended drawings, which illustrate the method and system of the invention, although it will be understood that such drawings depict preferred embodiments of the invention and, therefore, are not to be considered as limiting its scope with regard to other embodiments which the invention is capable of contemplating. Accordingly.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The present disclosure discusses a bullet loader and method of use which simplifies bullet magazine loading and enables a user to easily apply the necessary force to load bullets into a magazine. Hence, the bullet loader and method of use solve the need discussed in the background.

Figure 1:
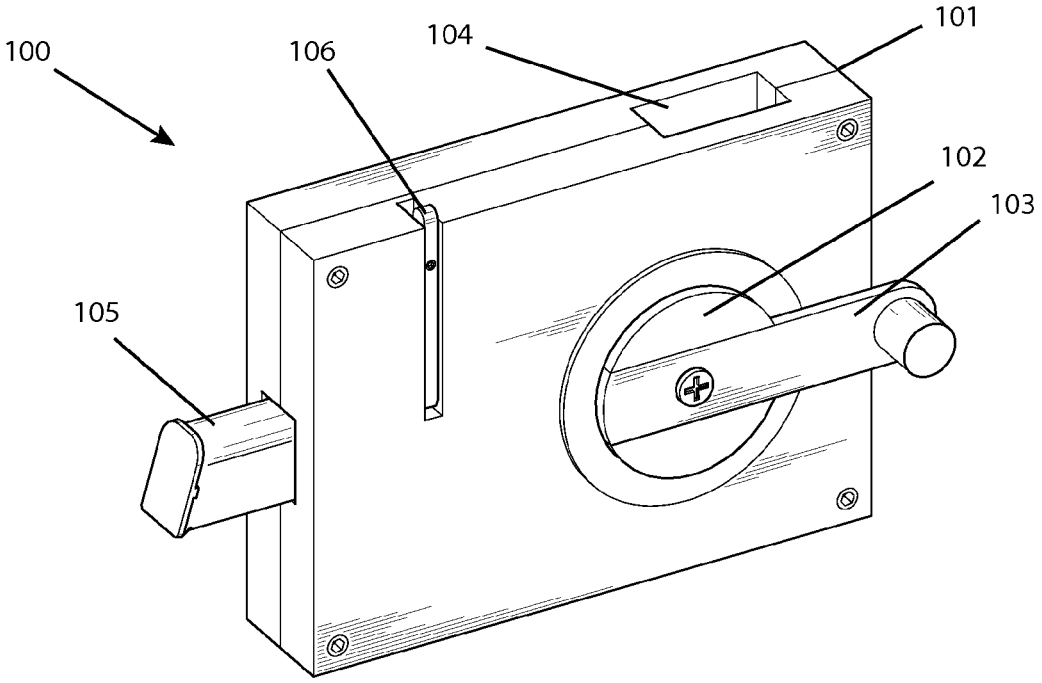
FIG. 1 shows a perspective view of a bullet loader embodiment.

FIG. 1 shows a perspective view of a bullet loader embodiment. Shown are the bullet loader 100, housing 101, cam 102, handle 103, feed opening 104, magazine 105, and rocker switch 106.

Figure 2:
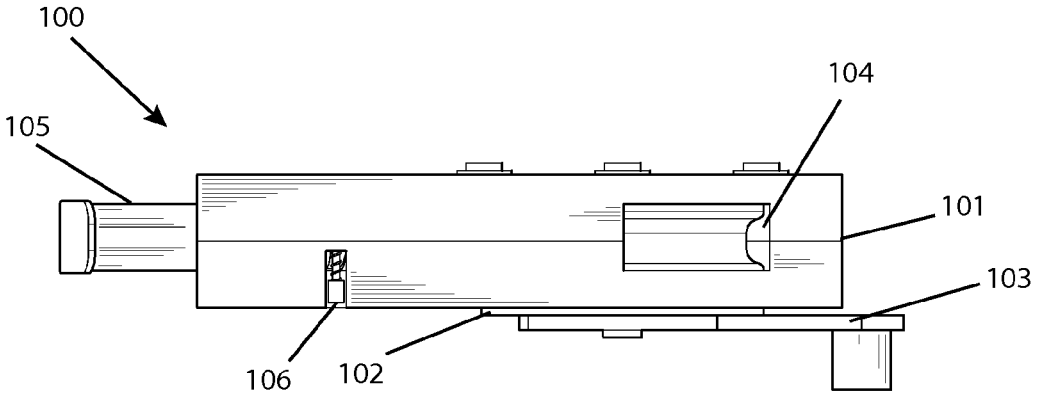
FIG. 2 shows a top view of a bullet loader embodiment.

FIG. 2 shows a top view of a bullet loader embodiment. Shown are the bullet loader 100, housing 101, cam 102, handle 103, feed opening 104, magazine 105, and rocker switch 106.

Figure 3:
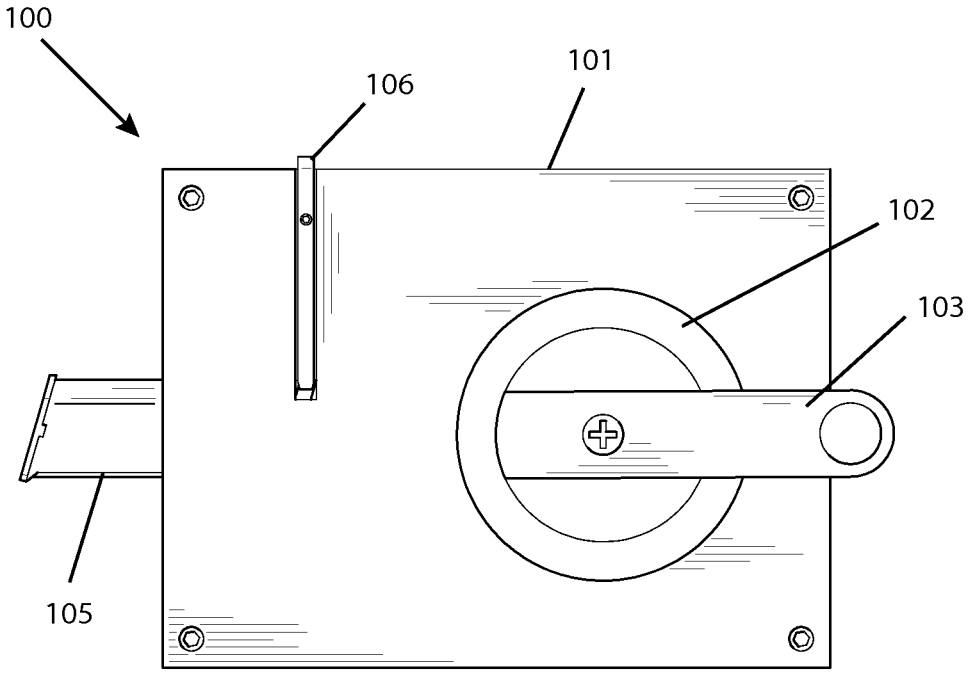
FIG. 3 shows a handle-side view of a bullet loader embodiment.

FIG. 3 shows a handle-side view of a bullet loader embodiment. Shown are the bullet loader 100, housing 101, handle 103, magazine 105, and rocker switch 106.

Figure 4:
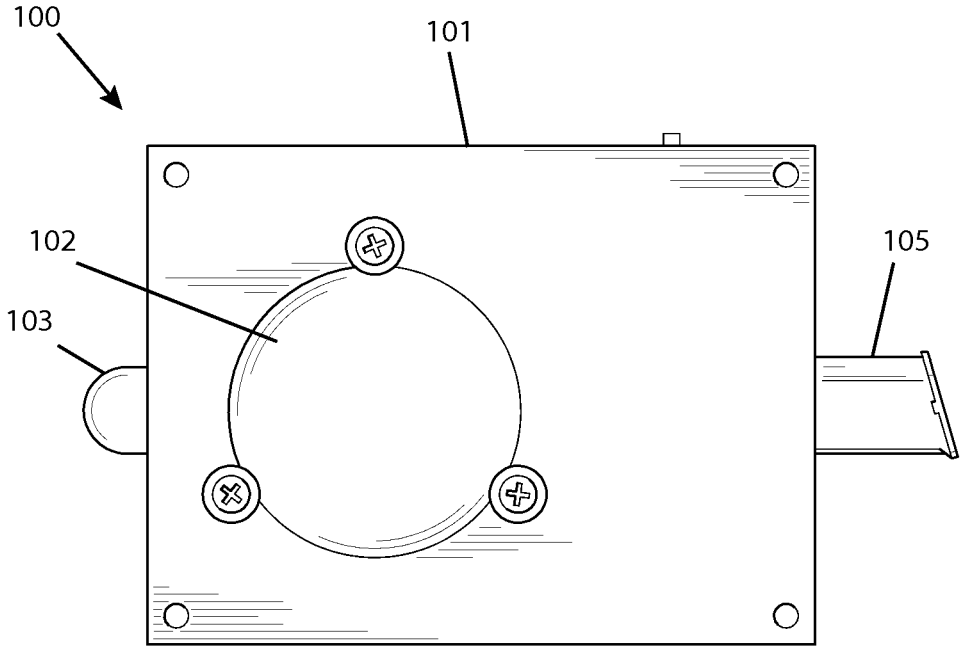
FIG. 4 shows a back-side view of a bullet loader embodiment.

FIG. 4 shows a back-side view of a bullet loader embodiment. Shown are the bullet loader 100, housing 101, cam 102, handle 103, and magazine 105.

Figure 5:
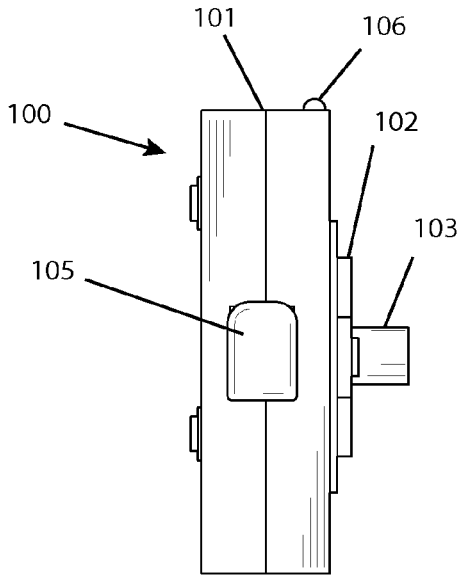
FIG. 5 shows a magazine-side view of a bullet loader embodiment.

FIG. 5 shows a magazine-side view of a bullet loader embodiment. Shown are the bullet loader 100, housing 101, cam 102, handle 103, magazine 105, and rocker switch 106.

Figure 6:
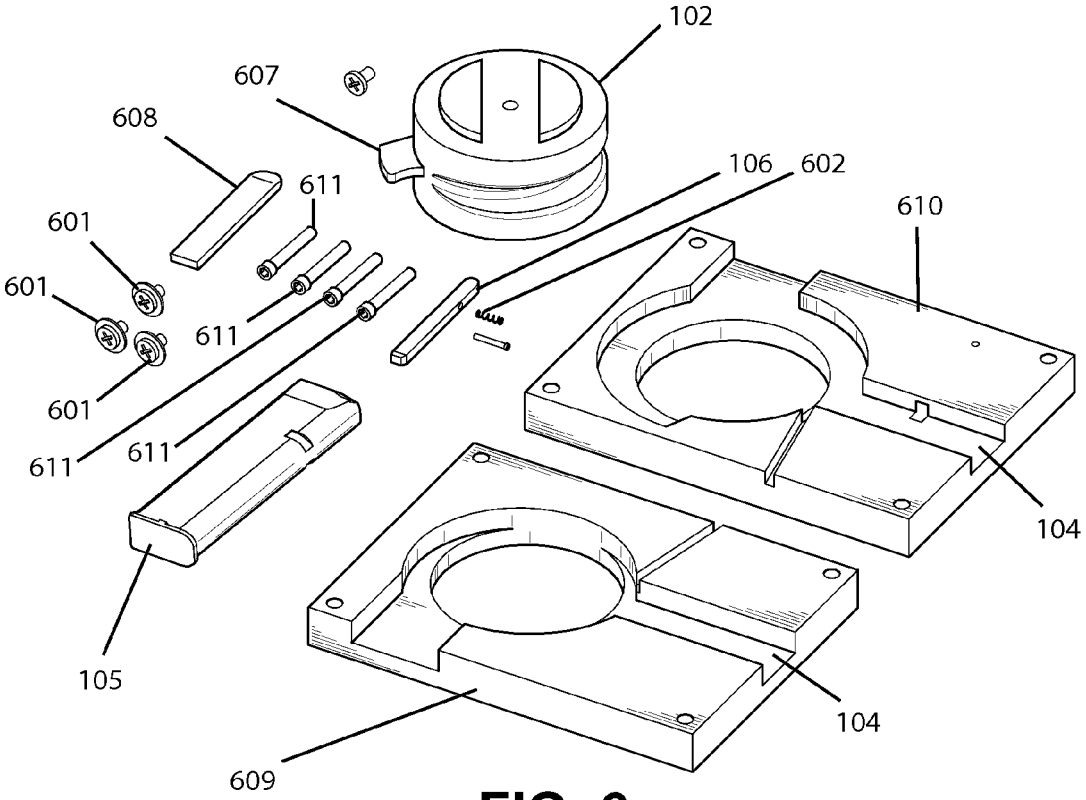
FIG. 6 shows a disassembled bullet loader embodiment.

FIG. 6 shows a disassembled bullet loader embodiment. Shown are cam 102, feed opening 104, magazine 105, and rocker switch 106, fasteners 601, bolts 611, rocker switch spring 602, and tongue 608. Also visible on cam 102 is cog 607. The housing 101 can be divided into a left housing section 609 and a right housing section 610, which are mirrored to complement each other.

Figure 7:
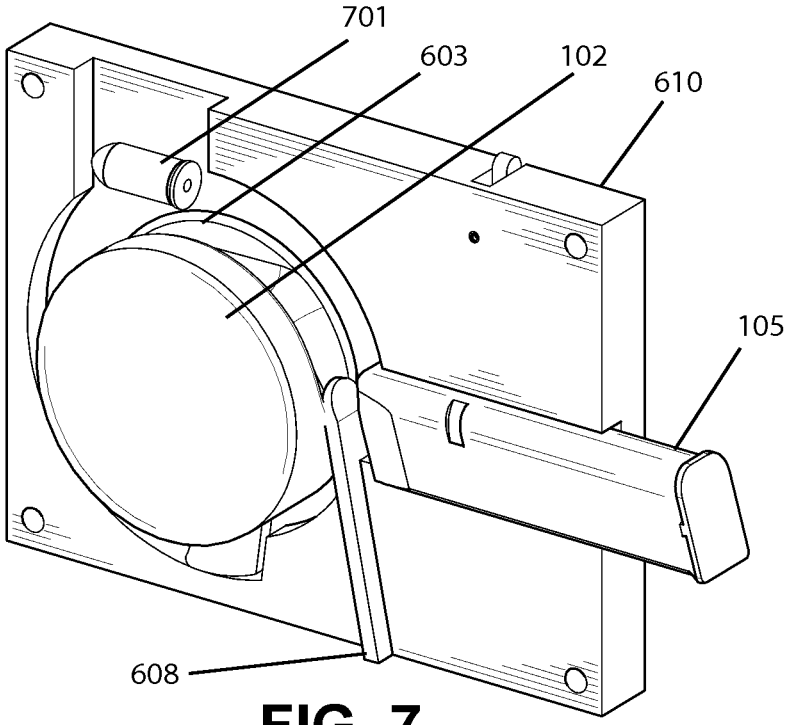
FIG. 7 shows a bullet position at step 1 of a bullet loading procedure.

FIG. 7 shows a bullet position at step 1 of a bullet loading procedure. Shown are the first indentation 603, a bullet 701, the cam 102, right housing section 610, magazine 105, and tongue 608.

Figure 8:
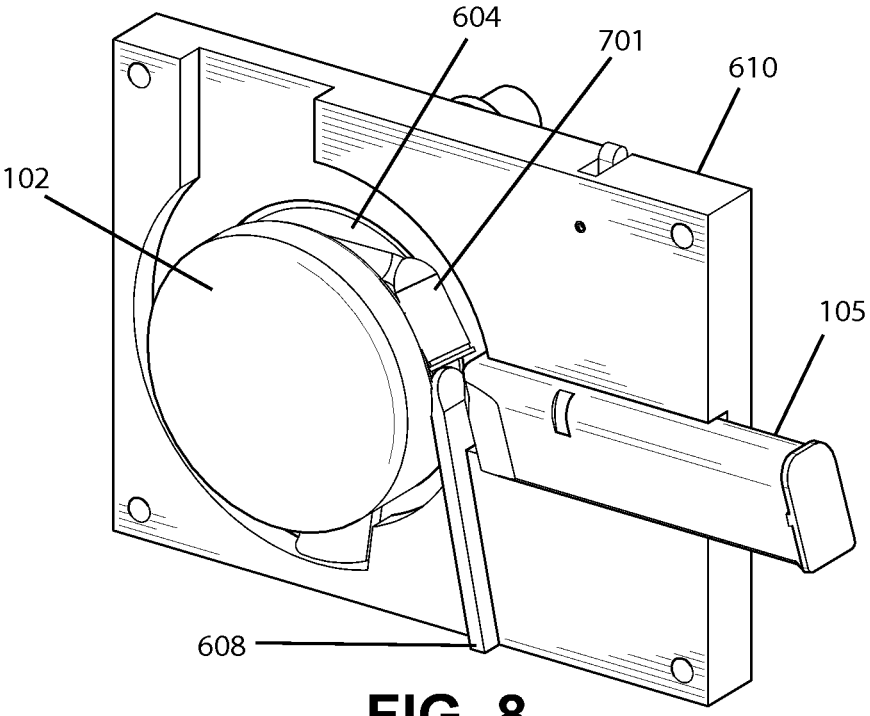
FIG. 8 shows a bullet position at step 2 of a bullet loading procedure.

FIG. 8 shows a bullet position at step 2 of a bullet loading procedure. Shown are the second indentation 604, a bullet 701, the cam 102, right housing section 610, magazine 105, and tongue 608.

Figure 9:
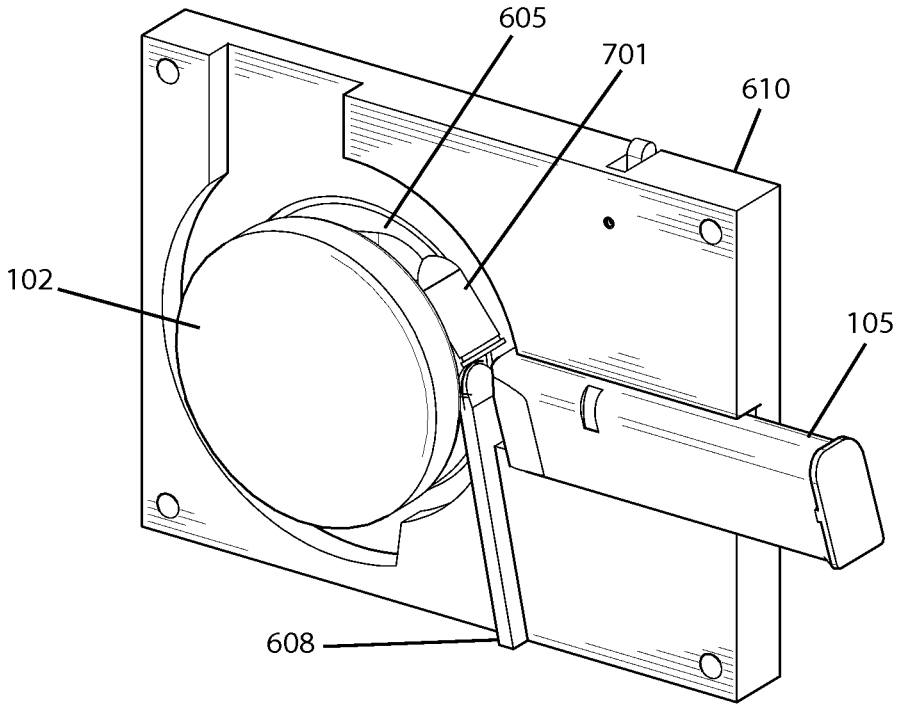
FIG. 9 shows a bullet position at step 3 of a bullet loading procedure.

FIG. 9 shows a bullet position at step 3 of a bullet loading procedure. Shown are the third indentation 605, a bullet 701, the cam 102, right housing section 610, magazine 105, and tongue 608.

Figure 10:
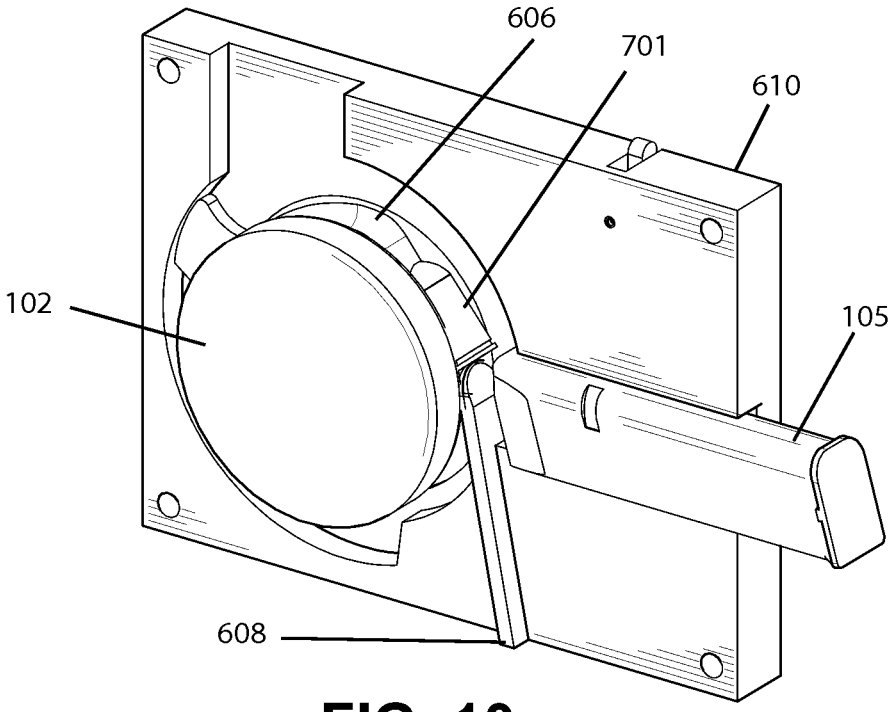
FIG. 10 shows a bullet position at step 4 of a bullet loading procedure.

FIG. 10 shows a bullet position at step 4 of a bullet loading procedure. Shown are the fourth indentation 606, a bullet 701, the cam 102, right housing section 610, magazine 105, and tongue 608.

Figure 11:
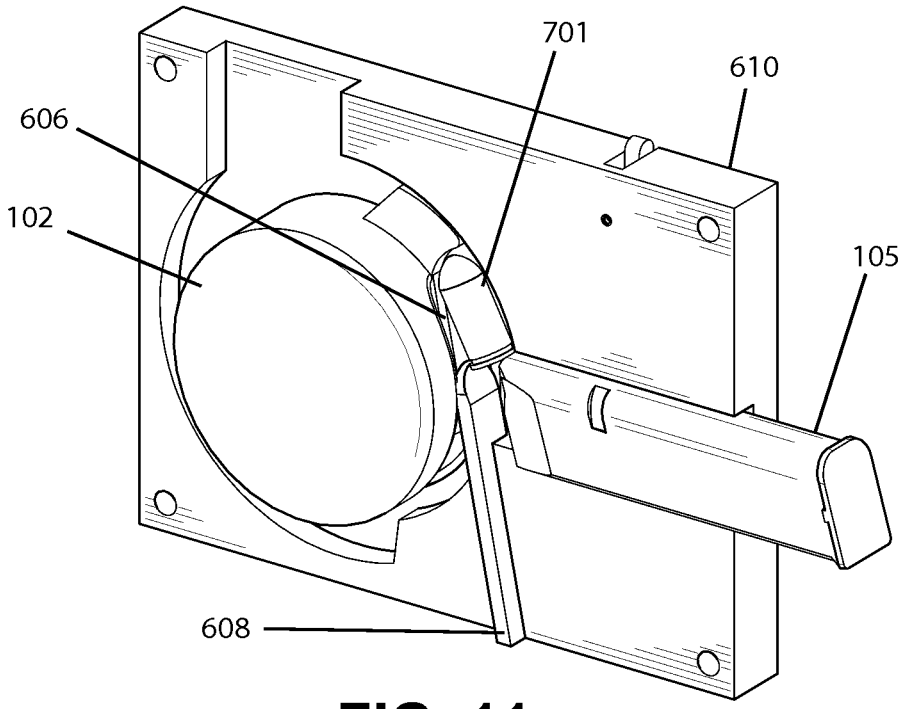
FIG. 11 shows a bullet position at step 5 of a bullet loading procedure.

FIG. 11 shows a bullet position at step 5 of a bullet loading procedure. Shown are the fourth indentation 606, a bullet 701, the cam 102, right housing section 610, magazine 105, and tongue 608.

Figure 12:
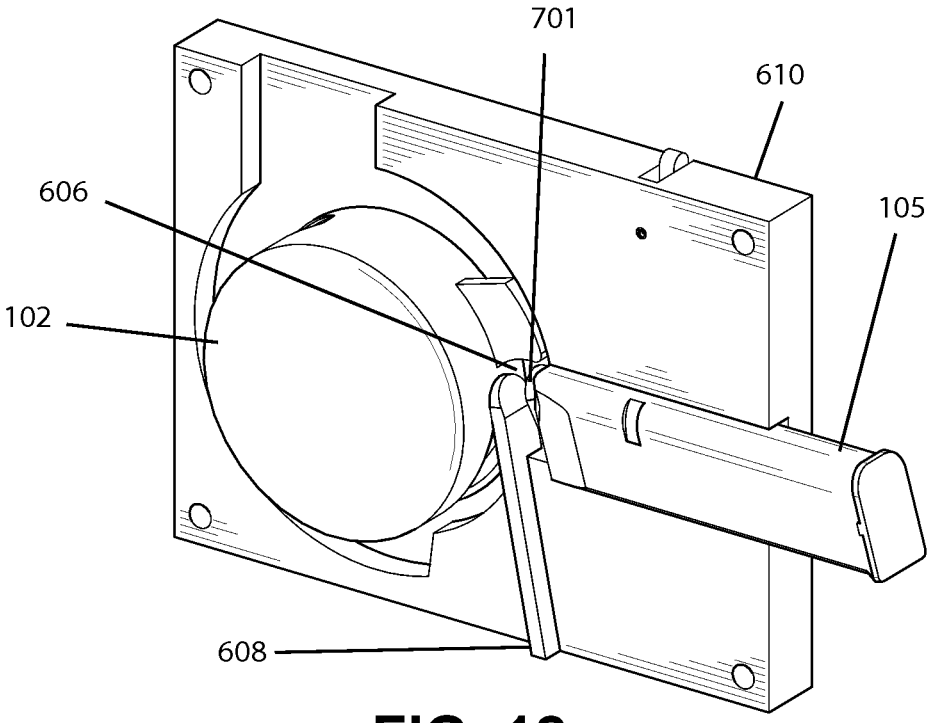
FIG. 12 shows a bullet position at step 6 of a bullet loading procedure.

FIG. 12 shows a bullet position at step 6 of a bullet loading procedure. Shown are the fourth indentation 606, a bullet 701, the cam 102, right housing section 610, magazine 105, and tongue 608.

Figure 13:
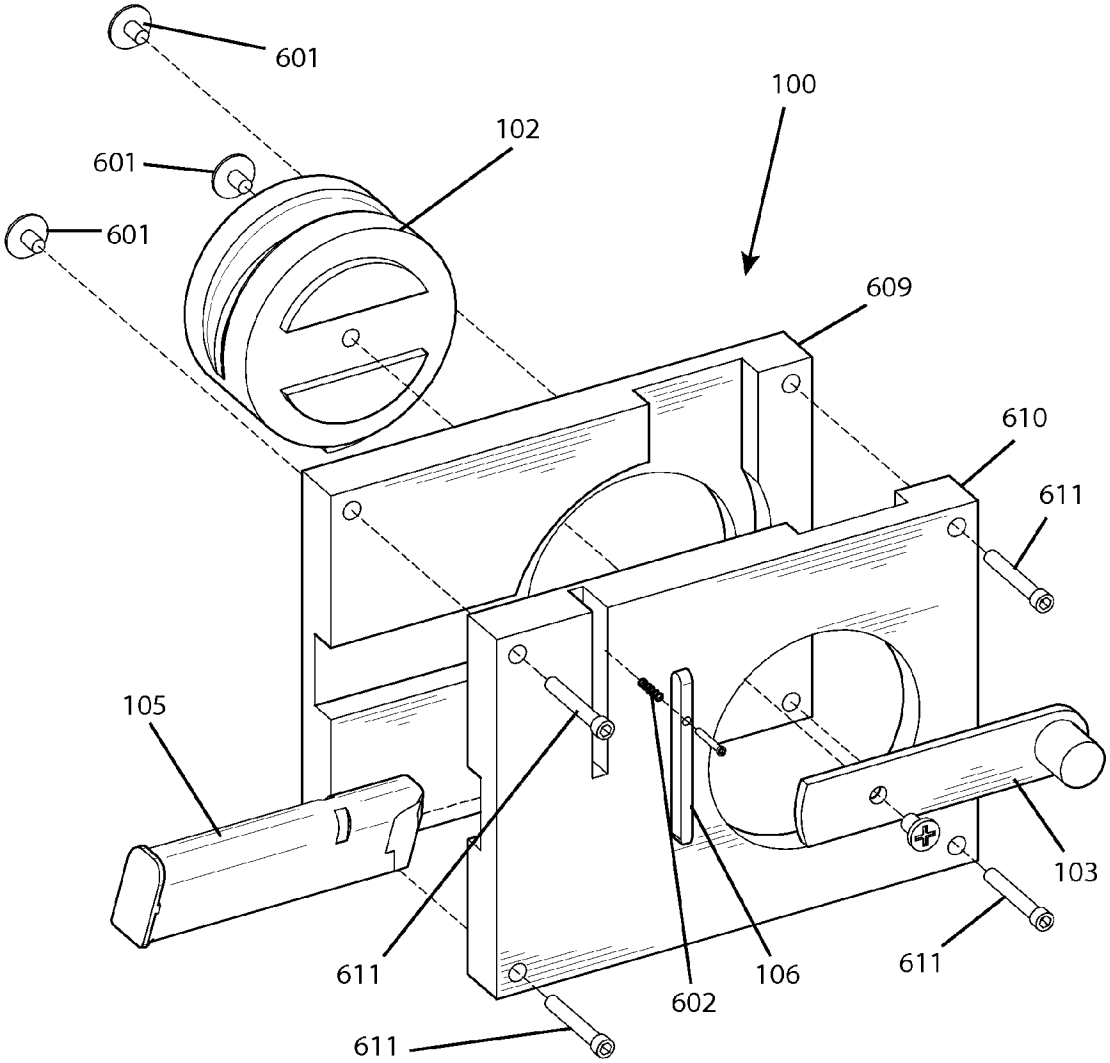
FIG. 13 shows an exploded view of a bullet loader embodiment.

FIG. 13 shows an exploded view of a bullet loader embodiment. Shown are the bullet loader 100, cam 102, handle 103, magazine 105, rocker switch 106, fasteners 601, bolts 611, left housing section 609, right housing section 610, and rocker switch spring 602.

Figure 14:
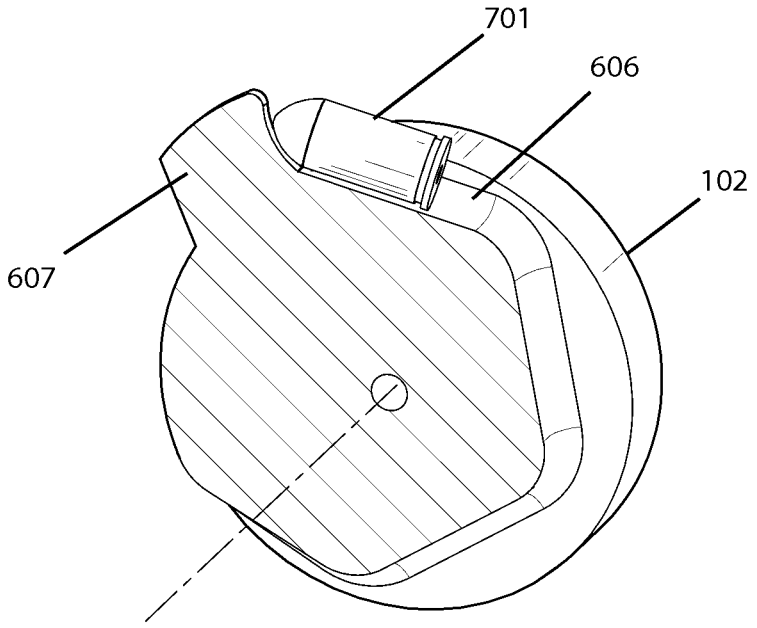
FIG. 14 shows a perspective view of a cam's fourth indentation in relation to a bullet.

FIG. 14 shows a perspective view of a cam's fourth indentation in relation to a bullet. Shown are bullet 701, cam 102, fourth indentation 606, and cog 607.

Figure 15:
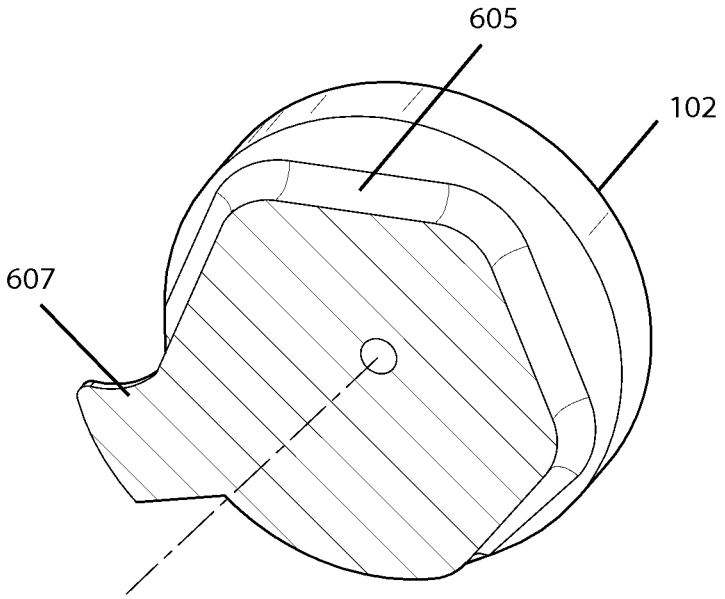
FIG. 15 shows a perspective view of a cam's third indentation.

FIG. 15 shows a perspective view of a cam's third indentation. Shown are cam 102, third indentation 605, and cog 607.

Figure 16:
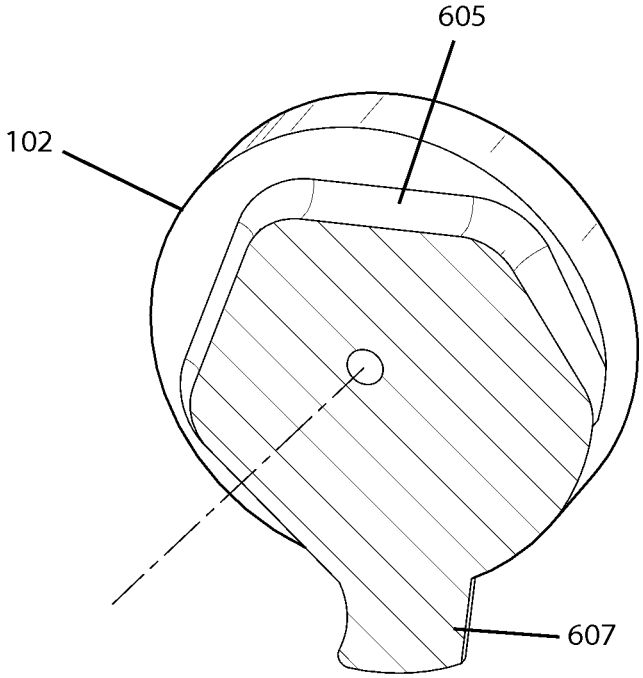
FIG. 16 shows a perspective view of a cam's second indentation.

FIG. 16 shows a perspective view of a cam's second indentation. Shown are cam 102, second indentation 604, and cog 607.

Figure 17:
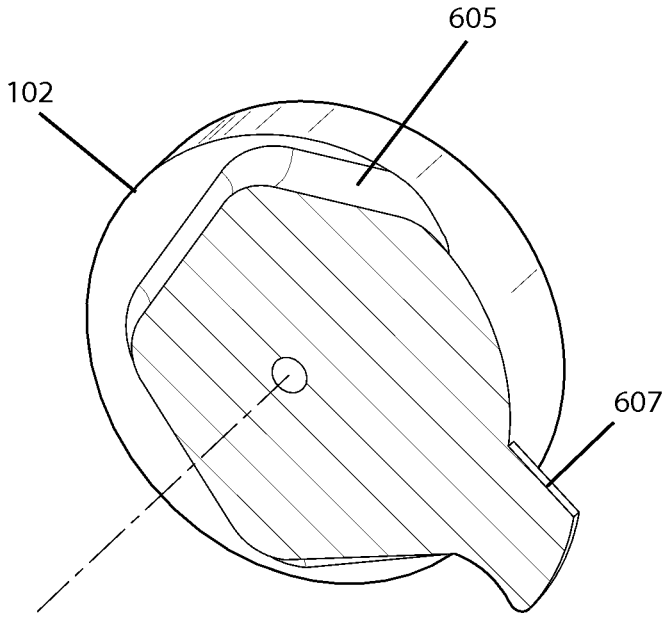
FIG. 17 shows a perspective view of a cam's first indentation.

FIG. 17 shows a perspective view of a cam's first indentation. Shown are bullet 701, cam 102, first indentation 603, and cog 607.

Figure 18:
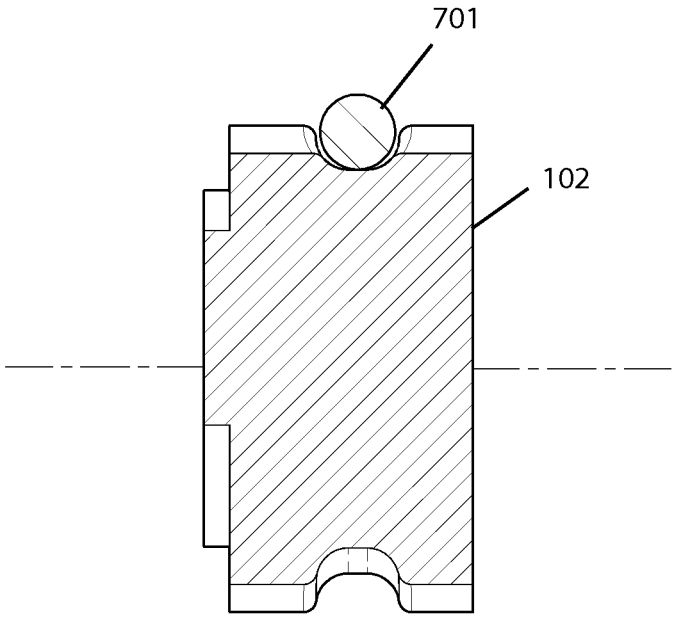
FIG. 18 shows a cross-section view of a cam's first indentation in relation to a bullet.

FIG. 18 shows a cross-section view of a cam's first indentation in relation to a bullet. Shown are a bullet 701 and the cam 102.

Figure 19:
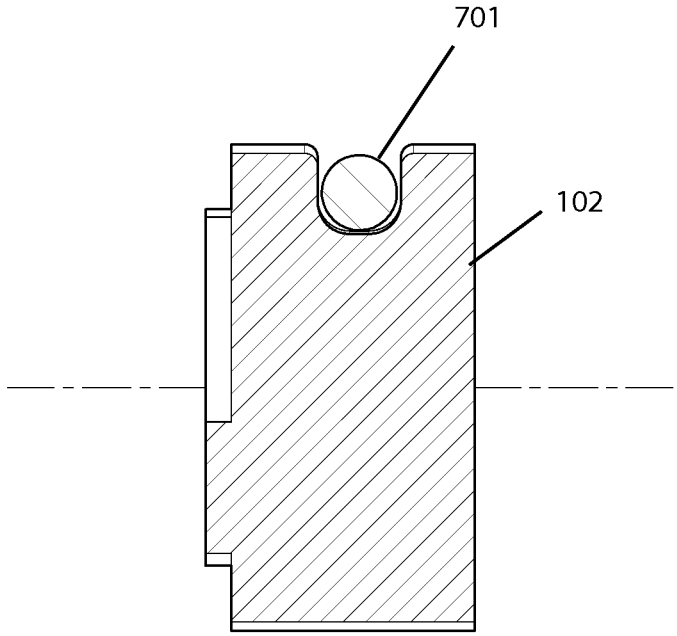
FIG. 19 shows a cross-section view of a cam's second indentation in relation to a bullet.

FIG. 19 shows a cross-section view of a cam's second indentation in relation to a bullet. Shown are a bullet 701 and the cam 102.

Figure 20:
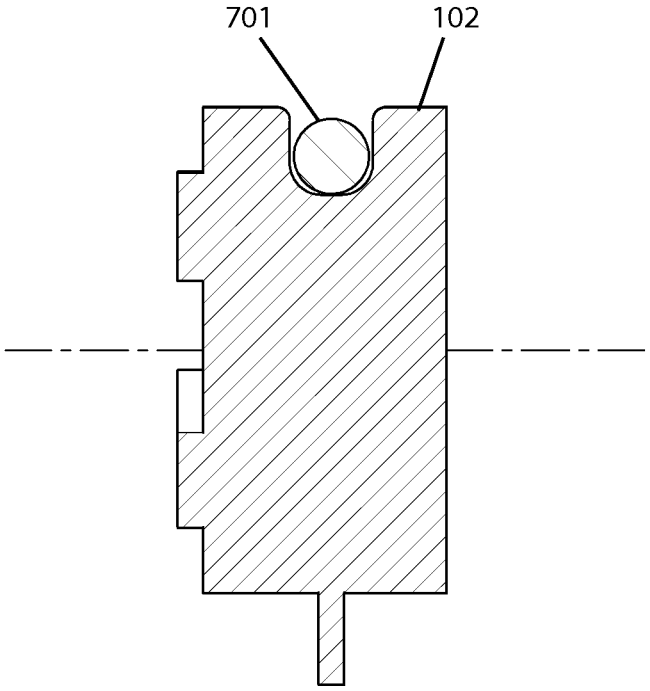
FIG. 20 shows a cross-section view of a cam's third indentation in relation to a bullet.

FIG. 20 shows a cross-section view of a cam's third indentation in relation to a bullet. Shown are a bullet 701 and the cam 102.

Figure 21:
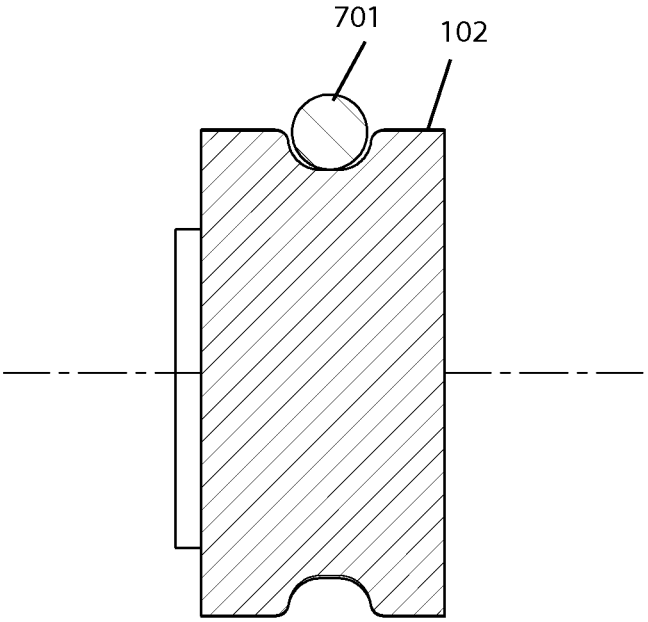
FIG. 21 shows a cross-section view of a cam's fourth indentation in relation to a bullet.

FIG. 21 shows a cross-section view of a cam's fourth indentation in relation to a bullet. Shown are a bullet 701 and the cam 102.

Figure 22:
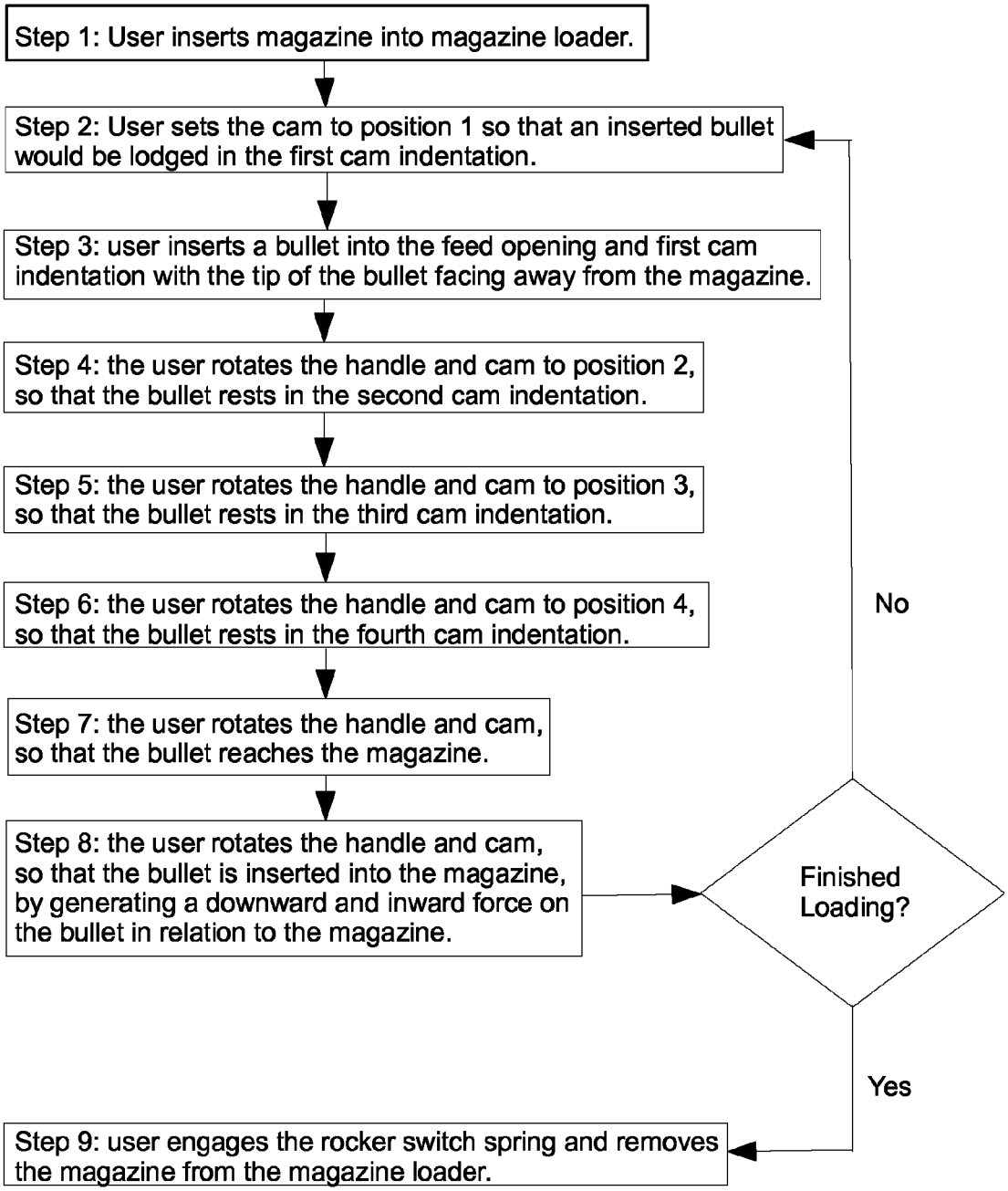
FIG. 22 shows a method flow diagram for filling a magazine with the bullet loader.

FIG. 22 shows a method flow diagram for filling a magazine with the bullet loader. Step 1: a user inserts a magazine into the magazine loader. Step 2: a user sets the cam to position 1 so that an inserted bullet would be lodged into the first cam indentation. Step 3: the user inserts a bullet into the feed opening and first cam indentation with the tip of the bullet facing away from the magazine. Step 4: the user rotates the handle and cam to position 2, so that the bullet rests in the second cam indentation. Step 5: the user rotates the handle and cam to position 3, so that the bullet rests in the third cam indentation. Step 6: the user rotates the handle and cam to position 4, so that the bullet rests in the fourth cam indentation. Step 7: the user rotates the handle and cam so that the bullet reaches the magazine. Step 8: the user rotates the handle and cam so that the bullet is inserted into the magazine, by generating a downward and inward force on the bullet in relation to the magazine. User repeats Steps 2 through 8 until as many bullets are loaded as desired. Step 9: user engages the rocker switch spring and removes the magazine from the magazine loader.

All patents and publications mentioned in the prior art are indicative of the levels of those skilled in the art to which the invention pertains. All patents and publications are herein incorporated by reference to the same extent as if each individual publication was specifically and individually indicated to be incorporated by reference, to the extent that they do not conflict with this disclosure.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations, and broad equivalent arrangements.

I claim:

1. A bullet loader configured to load a bullet into a gun magazine, the bullet loader comprising: a housing with an internal cam, wherein the cam has a first indentation configured to loosely hold a bullet, a second indentation which forms a half-cylinder shape, a third indentation configured to loosely hold the bullet, and a fourth indentation with a cog at an end.

2. The bullet loader of claim 1, wherein the bullet loader further comprises a handle attached to the internal cam that enables a user to rotate the cam when rotating the handle.

3. The bullet loader of claim 2, wherein the handle and cam rotate between 90 and about 270 degrees from a start of bullet loading to an insertion of the bullet into the gun magazine.

4. The bullet loader of claim 3, wherein the cam further comprises a notch configured to enable the cam to be seated within the housing.

5. The bullet loader of claim 1, wherein the housing further comprises two nearly mirrored sections.

6. The bullet loader of claim 5, wherein the housing further comprises a magazine opening capable of accepting a magazine and a feed opening capable of accepting a bullet.

7. The bullet loader of claim 6, wherein the housing further comprises a rocker switch able to lock the magazine into place.

8. The bullet loader of claim 1, wherein the first indentation has a depth from 5% to 50% of a bullet's diameter.

9. The bullet loader of claim 1, wherein the second indentation has a depth from 50% to 150% of a bullet's diameter.

10. The bullet loader of claim 1, wherein the third indentation has a depth equal to 5% to 75% of a bullet's diameter.

11. The bullet loader of claim 1, wherein the fourth indentation has a depth equal to 5% to 75% of a bullet's diameter.

12. The bullet loader of claim 1, wherein the indentations are merged into one continuous indentation with regions that have greater depth and regions that have lesser depth.

13. The bullet loader of claim 1, wherein the bullet loader further comprises a hopper attached to a feed opening that is configured to automatically feed bullets into the feed opening in an orientation with a bullet tip facing away from a magazine.

14. A method using a bullet loader, the method comprising:

inserting a magazine into a magazine opening of a bullet loader housing, wherein the bullet loader comprises: the housing with an internal cam, wherein the cam has a first indentation configured to loosely hold a bullet, a second indentation which forms a half-cylinder shape, a third indentation configured to loosely hold the bullet, and a fourth indentation with a cog at an end; and the magazine opening;

locking the magazine into place with the rocker switch;

aligning the cam so that the first indentation is aligned with the feed opening;

inserting a bullet;

rotating the cam to the second, third, and fourth cam positions consecutively so that the bullet is inserted into the magazine with both a downward and inward force;

iteratively repeating the aligning, inserting, and rotating steps until the magazine is filled;

unlocking the magazine with the rocker switch; and pulling the magazine out of the bullet loader.

* * * * *